United States Patent [19]

De Koning et al.

[11] Patent Number: 4,817,160

[45] Date of Patent: Mar. 28, 1989

[54] AMPLIFIER WITH AUTOMATIC GAIN CONTROL

[75] Inventors: Stephanus H. De Koning, Breda; Alexander Verwijmeren, Breda, both of Netherlands

[73] Assignee: U.S. Philips Corp., New York, N.Y.

[21] Appl. No.: 15,417

[22] Filed: Feb. 17, 1987

[30] Foreign Application Priority Data

Feb. 18, 1986 [NL] Netherlands ..... 8600405

[51] Int. Cl.[4] ..... H04R 27/00

[52] U.S. Cl. ..... 381/83; 381/93

[58] Field of Search ..... 381/83, 93, 98, 156

[56] References Cited

U.S. PATENT DOCUMENTS

| | | | |
|---|---|---|---|
| 4,079,199 | 3/1978 | Patronis, Jr. | 381/83 |
| 4,088,834 | 5/1978 | Thurmond | 381/83 |
| 4,525,856 | 6/1985 | Admiraal et al. | 381/83 |
| 4,602,337 | 7/1986 | Cox | 381/83 |

*Primary Examiner*—Forester W. Isen

*Attorney, Agent, or Firm*—Bernard Franzblau

[57] ABSTRACT

An amplifier in which the gain ($A_i$) is automatically controlled to a maximal value comprises means ($D_i$) for detecting ringing tones and means ($V_i$) for reducing the gain upon the detection of ringing tones. Also proposed is a circuit ($D_i$) for detecting ringing tones. A dynamic equilibrium can be obtained by alternately reducing the gain in the event of ringing tones and raising the gain in the absence of ringing tones.

20 Claims, 2 Drawing Sheets

AMPLIFIER WITH AUTOMATIC GAIN CONTROL

BACKGROUND OF THE INVENTION

This invention relates to an amplifier with automatic gain control.

U.S. Pat. No. 4,079,199 describes an automatically controlled amplifier arrangement in which the gain is controlled depending on the occurrence of oscillations.

If in such an arrangement one or more microphones are connected to the inputs and one or more loudspeakers are connected to the output, oscillations may occur in the event of acoustic feedback between one or more of the loudspeakers and one or more of the microphones. Such a situation may occur when the arrangement is used for amplifying speech signals or music signals in an auditorium. The frequencies of the oscillations depend, inter alia, on the geometry of the auditorium, the temperature and relative humidity in the auditorium, the distance between the speaker and the microphone, and the number of listeners in the auditorium. Therefore, the oscillation frequencies are of a more or less stochastic nature. In order to counteract these oscillations it is proposed in U.S. Pat. No. 4,079,199 to detect random oscillations and subsequently to reduce the gain of the arrangement until the oscillations are eliminated. After a waiting period the gain of the arrangement is then increased again automatically. As a result of this, it is always possible that in the known arrangement random oscillations occur, for example because the characteristics of the auditorium have changed, for example when the number of listeners has increased or decreased. These oscillations (howling) are annoying to the audience.

SUMMARY OF THE INVENTION

It is an object of the invention to eliminate or at least mitigate said drawback of the known arrangement and to this end an amplifier of the type defined in the opening sentence is characterized in that it comprises means for detecting ringing tones and means for reducing the gain upon the detection of ringing tones.

A further improvement of the amplifier in accordance with the invention is achieved in that it further comprises means for raising the gain in the absence of ringing tones. This enables the gain to be set to a higher desired value in the case of a decrease in acoustic feedback.

Ringing tones occur when the open-loop gain approximates to unity or, in other words, when the damping of a resonant circuit decreases excessively for the relevant frequency. When such ringing tones are detected, the gain is reduced, in accordance with the invention, so that these ringing tones are damped again. Ringing tones are hardly, or not at all perceptible by the audience although they can already be detected by the detection system and they can subsequently be eliminated before howling (oscillation) occurs. This is a significant advantage in comparison with the arrangement in accordance with U.S. Pat. No. 4,079,199.

Ringing tones have the property that their frequency is constant and their decay time is comparatively long. Suitably, the invention utilises these two properties for the detection of such ringing tones.

The invention also provides a means for detecting ringing tones which is characterized in that it comprises one or more frequency discriminators, preferably phase-locked loops, to which at least a portion of the signal to be amplified is applied, a clock means for defining a time interval T, a period counter for counting a number of periods n of the output signal of the phase-locked loop with a frequency f0, and a detection counter for counting the number of times N that the period counter has counted n oscillations within the time interval T.

A further disadvantage of the arrangement in accordance with U.S. Pat. No. 4,079,199 is that the gain cannot be optimized. This is because the gain is reduced until the oscillation just ceases at the frequency for which the maximum gain is obtained. This means that the gain may be too low for other frequency bands.

In order to preclude this problem it is proposed in accordance with the invention that the means for reducing the gain are constructed in such a way that the gain is reduced selectively in that frequency band in which a ringing tone is detected.

In accordance with the invention, the amplifier may further comprise means for raising the gain, which means are constructed in such a way that the gain is increased selectively in those frequency bands in which ringing tones are absent. Thus the gain can always be optimized for each of the frequency bands.

Preferably, the ringing-tone detector in accordance with the invention comprises a plurality of coupled phase-locked loops whose centre frequencies are offset relative to one another so as to cover a maximal frequency range.

In accordance with the invention the value of T lies suitably between 20 and 40 s, the value of n between 60 and 100, and the value of N between 1 and 4. This enables a maximum value for the gain setting to be obtained and the effect of ringing tones for the audience to be minimized. An optimum effect is obtained when $T/N \approx 10$ s and $n \approx 80$.

BRIEF DESCRIPTION OF THE DRAWINGS

The amplifier with means for detecting ringing tones in accordance with the invention will now be described in more detail, by way of example, with reference to the accompanying drawings, in which.

DESCRIPTION OF THE PREFERRED EMBODIMENTS

Figure 1:
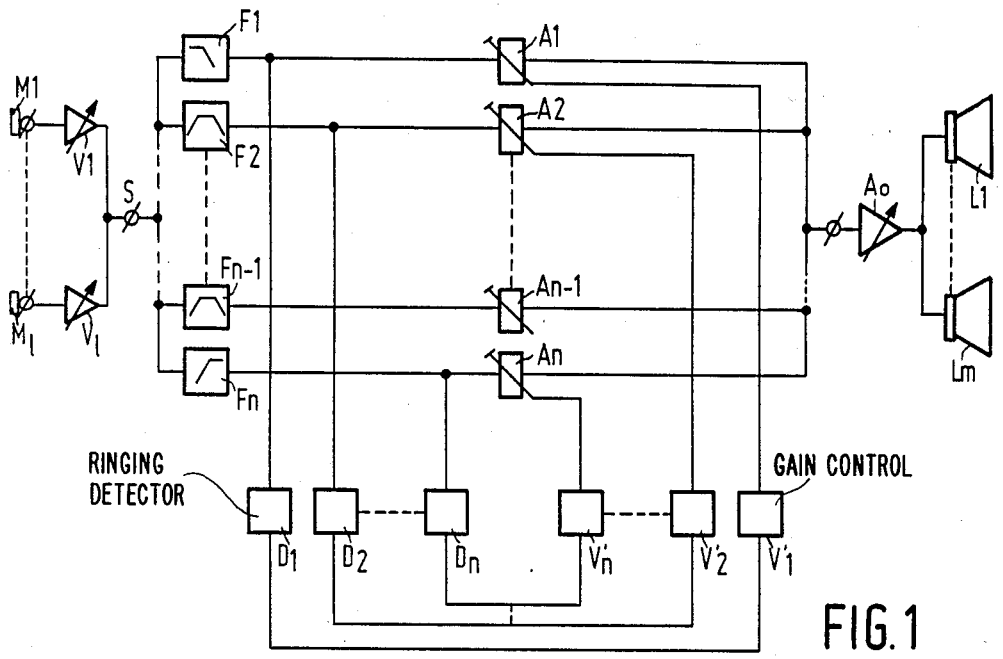
FIG. 1 shows a block diagram of the amplifier in accordance with the invention comprising a plurality of separately controlled channels.

In FIG. 1 microphones M1–$M_1$ are connected to separately controllable amplifiers V1–$V_1$. The outputs of the amplifiers V1–$V_1$ are connected to a signal summing device S having an output coupled to the inputs of the filters F1–Fn. The filter F1 is a low-pass filter and the filter Fn is a high-pass filter, F2 . . . Fn−1 being bandpass filters for intermediate frequency bands. The output signals of the filters F1-Fn are applied to variable attenuators A1–An and to ringing detectors D1–Dn. If a ringing tone is detected by one of the detectors D1–Dn, an output signal is applied to a corresponding one of the gain controls V'1–V'n. This gain control then varies the gain by a desired number of steps by means of the corresponding attenuator A1–An. The output signals of the attenuators A1–An are added to each other and applied to a variable amplifier A0, whose output signal is applied to loudspeakers L1–Lm.

Figure 2:
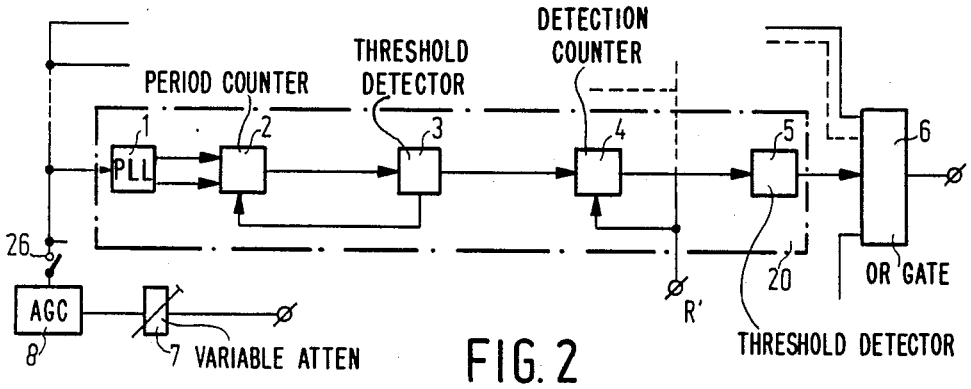
FIG. 2 shows a block diagram of a detection channel for an amplifier in accordance with the invention with single gain control.
Figure 3:
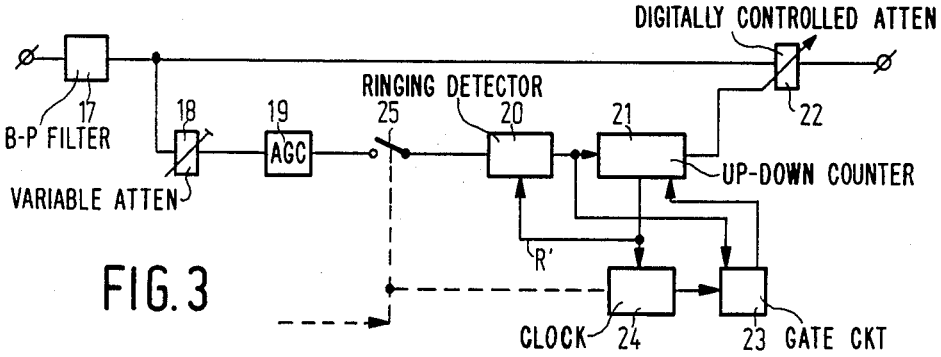
FIG. 3 shows a channel of the amplifier of FIG. 1 in further detail.

In the block diagram of FIG. 2 of a detection channel of an amplifier in accordance with the invention with simple gain control (detection being effected in different frequency bands but the gain being controlled simultaneously for the entire frequency range) the reference numeral 1 denotes a phase-locked loop to which the signal to be amplified is applied via a variable attenuator 7 and an automatic gain control 8. The phase-locked loop 1 has two outputs. One output indicates that the oscillator is in lock and the other output supplies the oscillation signal of the frequency f0 in the non-locked condition. When the phase-locked loop is in lock, i.e. when oscillations of a frequency near the frequency f0 of the phase-locked loop occur on the input of this phase-locked loop, the periods of the output signal of the phase-locked loop are counted by the period counter 2. When the count of the counter 2 exceeds the value n detection is effected by the threshold detector 3 and a pulse signal is transferred to the detection counter 4. When the count of the counter 4 exceeds the value N during a time interval T, this is detected by the threshold detector 5, which supplies an output signal to the OR gate 6. The output signal of the OR gate 6 then controls a variable attenuator, which reduces the gain of the arrangement by a desired number of steps. The time interval T is defined by means of the clock 24. The counter 2 is reset by means of the threshold detector 3 when the threshold n is exceeded or by means of the signal L/NL when the threshold n is not exceeded (see also FIG. 3), NL being the logic "1" signal. In the manner shown in FIG. 3 the counter 4 is reset (signal R'). The counter 4 is reset (R') in the same way as illustrated in FIG. 3 for the ringing detector 20. The output signal of the OR gate 6 can be used for controlling the gain in the same way as the output of 20 (FIG. 3). The reference numeral 26 indicates a switch which can be opened automatically when the audio signal is not adequate.

Figure 4:
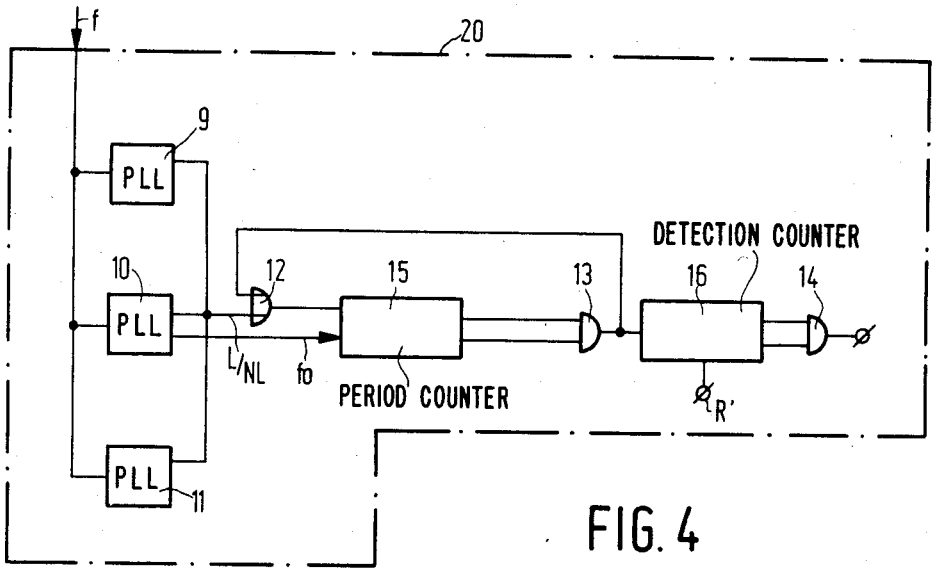
FIGS. 4 and 5 illustrate the use of a plurality of phase-locked loops in a channel.

In FIG. 3, which shows a channel of the amplifier of FIG. 1 in further detail, the reference numeral 17 denotes a band-pass filter, the reference numeral 18 a variable attenuator, the numeral 19 an automatic gain control, the numeral 20 a ringing detector, such as for example shown in FIG. 2 or FIG. 4, the reference numeral 21 an up-down counter, the reference numeral 22 a digitally controlled attenuator, the reference numeral 23 a gate circuit, the reference numeral 24 a clock, and the reference numeral 25 a switch. When the signal to be amplified is not strong enough, the switch 25 is opened automatically and the clock 24 is reset automatically, so that no gain control is applied. The output signal of the clock 24 and the output signal of the ringing detector 20 are applied to the gate circuit 23. When N ringing tones have been detected in the time interval T defined by the clock 24, the gate circuit 23 supplies a control signal to the up/down counter 21, causing the count of the counter 21 to be changed by one step and the setting of the digitally controlled attenuator 22 to be changed accordingly. Moreover, the counter 21 then resets the clock 24 and the ringing detector 20.

The clock ensures that the gain for a channel in FIG. 3 is incremented by one step for every period T at least when less than N ringing tones have been detected in this period T. In this way the gain of this channel is balanced in such a way that the acoustic gain lies between two selected values. These values depend on the selected T, n and N and on the magnitude of the steps of the attenuators (22 in FIG. 3) in the audio amplifiers. A variation of T means a variation of the average howling margin.

Figure 5:
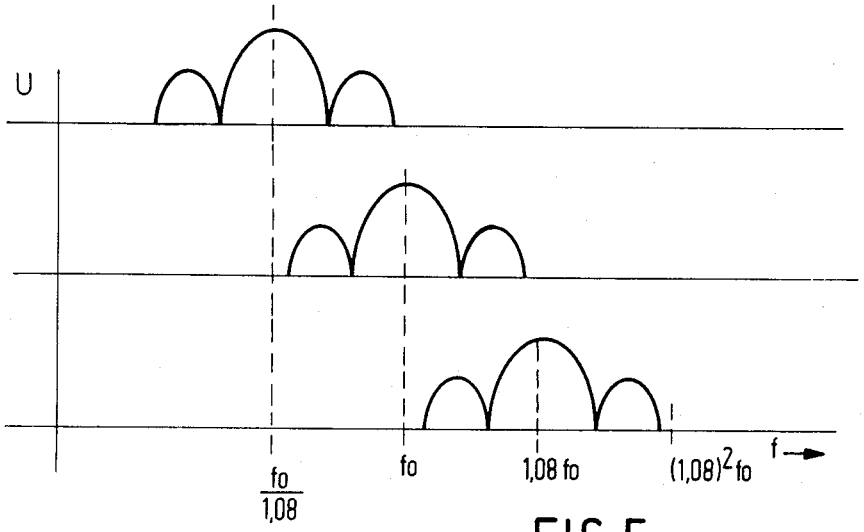

FIGS. 4 and 5 illustrate an efficient use of a number of phase-locked loops in accordance with the invention. For a specific frequency band three phase-locked loops are employed. FIG. 5 illustrates the locking sensitivity (U) of each of the phase-locked loops of FIG. 4 as a function of the frequency f of a toneburst which is used as a model for the input signal applied to a phase-locked loop. The centre frequency of each phase-locked loop is equal to $(1+x)$ times the centre frequency of the preceding phase-locked loop (where x depends on the type of phase-locked loop used and may have a typical value of approximately 0.08). When the configuration shown in FIG. 4 is employed and a suitable choice is made for the centre frequency in accordance with FIG. 5 it is possible to use a comparatively small number of phase-locked loops for a specific frequency band. The output signal L/NL of the phase locked loops 9, 10 and 11 is applied to one input of the OR gate 12, the output signal of the AND gate 13 being applied to the other input. (The signal L/NL becomes "0" when one of the phase-locked loops is locked. A negligible counting error occurs because f0 is always counted and not always the frequency of the actually locked PLL.) When one of the circuits 9, 10 or 11 is in lock, the number of oscillations of the output signal f0 of the phase-locked loop 10 is counted by the period counter 15. When the count of the period counter 15 exceeds the value n the AND gate 13 supplies a signal to the detection counter 16, so that the counter 15 is also reset (OR gate 12). When the count of the detection counter 16 exceeds the value N the AND gate 14 generates a signal by means of which the gain can be reduced.

This signal may be employed, for example as shown in FIG. 3, for reducing the gain in a specific channel. The counter 15 is reset in the manner as indicated in FIG. 3 (R').

A complication is that not all the ringing tones result from excessive acoustic feedback of the amplifier. The original spech contains preferential tones which may be interpreted as ringing tones by the arrangement. In addition, the passive space itself has preferential frequencies (resonances). These ringing tones are also detected. However, when n is selected to be approximately 80, T to be approximately 30, and N to be approximately 3, these ringing tones are detected less frequently on the average than ringing tones resulting from excessive acoustic feedback.

The invention is not limited to the embodiments shown in the Figures. Other variants also fall within the scope of the invention. For example, for a channel corresponding to a specific frequency band (a specific filter), depending on the bandwidth of the filter, a plurality of ringing-tone detectors may be used, whose output signals are applied to an OR gate (as described with reference to FIG. 2). For each channel there is then provided an up/down counter 21 to which the output signal of the OR gate is applied, a clock 24 and a gate circuit 23, which elements are arranged as indicated in FIG. 3. The output signal of this OR gate may then be used for gain control in a manner as described with reference to FIG. 3. In principle, the invention also relates to an arrangement comprising only one channel in which ringing-tone detection over the entire frequency range is effected by means of a single ringing-tone detector and the gain for the entire frequency range is controlled by means of a single variable amplifier.

What is claimed is:

1. An amplifier with automatic control of the gain to a maximal value comprising an amplifier receiving a signal to be amplified, means for detecting ringing tones, and means responsive thereto for reducing the gain of said amplifier upon detection of the ringing tones, wherein the detecting means comprise at least one frequency discriminator having a characteristic frequency f0 to which at least a portion of the signal to be amplified is applied, a clock means for defining a time interval T, a period counter for counting a number of periods n of an output signal of the frequency discriminator, and a detection counter for counting the number of times N that the period counter has counted n ringing tones within the time interval T, where $n>60$.

2. An amplifier as claimed in claim 1, further comprising means for raising the amplifier gain in the absence of ringing tones.

3. An amplifier as claimed in claim 1 or 2, characterized in that the means for reducing the gain are constructed in such a way that the gain is reduced selectively in that frequency band in which a ringing tone is detected.

4. An amplifier as claimed in claim 2 wherein the means for raising the gain are constructed in such a way that the gain is increased selectively in those frequency bands in which ringing tones are absent.

5. An amplifier as claimed in claim 4 wherein the means for reducing the gain are arranged so that the gain is reduced selectively in that frequency band in which a ringing tone is detected.

6. An amplifier as claimed in claim 1 characterized in that the frequency discriminator comprises a plurality of coupled phase-locked loops whose center frequencies are offset relative to one another and $20<T<40$ seconds.

7. An amplifier as claimed in claim 1 or 2, characterized in that the frequency discriminator comprises a plurality of coupled phase-locked loops whose centre frequencies are offset relative to one another.

8. An amplifier as claimed in claim 1 or 2, characterized in that $20<T<40$ s.

9. An amplifier as claimed in claims 1 or 2, characterized in that $60<n<100$.

10. An amplifier as claimed in claims 1 or 2, characterized in that $1<N<4$.

11. An amplifier as claimed in claim 1, characterized in that $T/N\approx 10$ s.

12. An amplifier as claimed in claims 1 or 2, characterized in that $n\approx 80$.

13. An amplifier as claimed in claim 1 wherein $20<T<40$ seconds and $60<n<100$.

14. An amplifier as claimed in claim 13 wherein $1\leqq N\leqq 4$.

15. An amplifier as claimed in claims 13 or 14 wherein $T/N\approx 10$ seconds.

16. An amplifier as claimed in claims 13 or 14 wherein $n\approx 80$.

17. An amplifier with automatic gain control comprising:

an amplifier receiving an input signal to be amplified, means for detecting ringing tones and means responsive thereto for reducing the gain of said amplifier upon detection of the ringing tones, said detecting means comprising at least one frequency discriminator having a characteristic frequency f0 to which at least a portion of the signal to be amplified is applied, clock means for defining a time interval T, a period counter for counting a number of periods n of an output signal of the frequency discriminator and a detection counter for counting the number of times N that the period counter has counted n ringing tones within the time interval T, and wherein the frequency discriminator comprises a phase locked loop.

18. An amplifier with automatic gain control comprising: an input terminal for signals to be amplified, an amplifier coupled to said input terminal, means coupled to said intput terminal for detecting ringing tones, and means controlled by said detecting means for reducing the amplifier gain in response to detection of ringing tones, wherein the detecting means comprise at least one frequency discriminator having a characteristic frequency $f_0$ and with an input to which at least a portion of the signal to be amplified is applied, means for defining a time interval T, a period counter for counting a number of periods n of an output signal of the frequency discriminator, a detection counter responsive to the period counter for counting the number of times N that the period counter has counted n ringing tone periods within the time interval T, and wherein the amplifier gain reducing means reduces the amplifier gain selectively only in a limited frequency band in which a ringing tone is detected.

19. An amplifier as claimed in claim 18 including means for raising the amplifier gain in the absence of ringing tones, said amplifier gain raising means increasing the amplifier gain selectively only in those frequency bands devoid of ringing tones.

20. An amplifier as claimed in claims 18 or 19 wherein said frequency discriminator comprises a plurality of coupled phase locked loops having different center frequencies.

* * * * *